US005549950A

United States Patent [19]

Murolo

[11] Patent Number: 5,549,950

[45] Date of Patent: Aug. 27, 1996

[54] FLEXIBLE WATERPROOF APPLIQUE FOR ACCURATE MOUNTING DIRECTLY TO SWIMMING POOLS AND THE LIKE

[76] Inventor: David Murolo, 2 Evergreen Dr., Manorville, N.Y. 11949

[21] Appl. No.: 406,630

[22] Filed: Mar. 20, 1995

Related U.S. Application Data

[63] Continuation-in-part of Ser. No. 249,714, May 26, 1994, abandoned.

[51] Int. Cl.[6] ..... G09F 1/10

[52] U.S. Cl. ..... 428/41.7; 40/773; 40/775; 428/40; 428/42.1; 428/43; 428/69; 428/137; 428/138; 428/202; 428/205; 428/220; 428/354; 428/914; 428/41.8

[58] Field of Search ..... 428/40, 41, 42, 428/43, 138, 137, 220, 354, 202, 205, 914, 69; 40/158.1, 773, 775

[56] References Cited

U.S. PATENT DOCUMENTS 3,987,569 10/1976 Chase ..... 40/158.1
4,125,653 11/1978 Muzik ..... 428/40

*Primary Examiner*—Nasser Ahmad

[57] ABSTRACT

A flexible waterproof applique directly mountable to a swimming pool and the like includes a flexible waterproof sheet, a waterproof adhesive layer, and a waterproof release sheet. The flexible waterproof sheet has a flexible waterproof sheet front surface and a flexible waterproof sheet rear surface. The waterproof adhesive layer entirely covers the flexible waterproof sheet rear surface so that water in the swimming pool is prevented from coming between the flexible waterproof sheet and the swimming pool to prevent lifting of the flexible waterproof sheet away from the swimming pool interior surface. The waterproof release sheet contains at least two slits which define at least one release sheet intermediate portion and at least two release sheet outer portions. Each of the at least two release sheet outer portions is larger than each of the at least one release sheet intermediate portion so that by removing one of the release sheet intermediate portion, a portion of the waterproof adhesive layer becomes exposed and allows the flexible waterproof sheet to be initially properly positioned on the swimming pool interior surface. By progressively removing each remaining release sheet intermediate portion and each of the at least two release sheet outer portions the initially properly positioned flexible waterproof sheet is progressively adhered to the swimming pool interior surface free of wrinkles and bubbles.

4 Claims, 2 Drawing Sheets

FLEXIBLE WATERPROOF APPLIQUE FOR ACCURATE MOUNTING DIRECTLY TO SWIMMING POOLS AND THE LIKE

CROSS REFERENCE TO RELATED APPLICATIONS

This application is a continuation-in-part of application Ser. No. 249,714 filed on May 26, 1994 and now abandoned.

BACKGROUND OF THE INVENTION

1. Field of the Invention

The present invention relates to appliques. More particularly, the present invention relates to a flexible waterproof applique for accurate mounting directly to swimming pools and the like.

2. Description of the Prior Art

Various methods and means have been devised for permanently mounting pictures on surfaces that use a variety of adhesives and devices. Liquid adhesives are messy and frequently damage the picture and the surface and also require considerable skill and care in their use. Adhesives that must be moistened have to be applied commercially. Mounting tissues require prolonged heat and pressure applied with specialized equipment. Pressure-sensitive adhesives have been used but it has proved to be extremely difficult to mount a picture properly with these adhesives since there has been no provision for preventing accidental contact between the picture and the surface while the picture was being positioned on the surface. Any attempt to move the picture after accidental contact damaged the picture and/or the surface.

Furthermore, in the past it has generally been necessary to carefully measure and draw construction lines on the face of a surface in order to assure that a picture would be properly located and aligned on the surface. Such construction lines could not be completely removed.

U.S. Pat. No. 3,987,569 to Chase teaches an adhesive picture mount that is attachable to a wall. A description of which can best be made with reference to FIGS. 1 and 2.

The adhesive picture mount includes a thick and rigid base member with a front surface for receiving a picture and a rear surface for mounting to a wall. An adhesive layer is disposed on part of the front surface and a release sheet is positioned over the adhesive layer. The release sheet is made up of three independent sections that are each removed individually. The picture must first be mounted to the thick and rigid base member which in turn is then mounted to a wall. Thus no mounting directly of a picture to a wall is provided. Furthermore, both the adhesive layer and the release sheet are not waterproof and are located on part of the thick and rigid base member not the picture.

To apply the teachings of Chase to the present invention would require that the adhesive and the release sheet be located on the rigid swimming pool inner surface and that the waterproof flexible applique would have to be applied thereon. This arrangement would provide for a horrendous situation. The entire rigid swimming pool inner surface would have to be covered with an adhesive layer and a release sheet so that the user can apply the applique at any position on the swimming pool inner surface. With this arrangement, a specific section of the release sheet that is analogous to the shape of the applique must be removed, quite a tedious task to accomplish especially when the swimming pool is full of water.

Since the applique of the present invention is applied while the swimming pool is full of water, both the release sheet and the adhesive layer are waterproof and specifically the adhesive layer is resistant to prolonged exposure to the degrading effects of chlorine water.

Additionally, the adhesive layer is applied over the entire back surface of the applique so that the chlorine water is prevented from coming in contact with the back side of the mounted applique and lift the applique off of the swimming pool inner surface.

In an attempt to waterproof a surface, U.S. Pat. No. 4,125,653 to Muzik teaches photographic paper provided with a water resistant layer to prevent moisture absorption and wrinkling during drying. This teaching addresses the prevention of moisture absorption and wrinkling during drying but does not address the prevention of moisture absorption and wrinkling during continuous submersion in chlorine water.

Numerous other innovations for appliques have been provided in the prior art. However, even though these innovations may be suitable for the specific individual purposes to which they address, they differ from the present invention. Even though these innovations may be suitable for the specific individual purposes to which they address, they would not be suitable for the purposes of the present invention as heretofore described.

SUMMARY OF THE INVENTION

ACCORDINGLY, IT IS AN OBJECT of the present invention is to provide a flexible waterproof applique for accurate mounting directly to swimming pools and the like that avoids the disadvantages of the prior art.

ANOTHER OBJECT of the present invention is to provide a flexible waterproof applique for accurate mounting directly to swimming pools and the like that is simple and inexpensive to manufacture.

STILL ANOTHER OBJECT of the present invention is to provide a flexible waterproof applique for accurate mounting directly to swimming pools and the like that is simple to apply.

YET ANOTHER OBJECT of the present invention is to provide a flexible waterproof applique for accurate mounting directly to swimming pools and the like that includes a flexible waterproof sheet, a waterproof adhesive, and a waterproof release sheet.

STILL YET ANOTHER OBJECT of the present invention is to provide a flexible waterproof applique for accurate mounting directly to swimming pools and the like wherein the flexible waterproof sheet has a flexible waterproof sheet front surface and a flexible waterproof sheet rear surface.

YET STILL ANOTHER OBJECT of the present invention is to provide a flexible waterproof applique for accurate mounting directly to swimming pools and the like wherein the waterproof adhesive layer entirely covers the flexible waterproof sheet rear surface so that water in the swimming pool is prevented from coming between the flexible waterproof sheet and the swimming pool to prevent lifting of the flexible waterproof sheet away from the swimming pool.

STILL YET ANOTHER OBJECT of the present invention is to provide a flexible waterproof applique for accurate mounting directly to swimming pools and the like wherein the waterproof release sheet contains at least two slits that are located therethrough and which define at least one release sheet intermediate portion and at least two release sheet outer portions.

YET STILL ANOTHER OBJECT of the present invention is to provide a flexible waterproof applique for accurate mounting directly to swimming pools and the like wherein each of the at least two release sheet outer portions is larger than each of the at least one release sheet intermediate portion so that by removing one of the at least one release sheet intermediate portion, a portion of the waterproof adhesive layer becomes exposed and allows the flexible waterproof sheet to be initially properly positioned on the swimming pool inner surface.

STILL YET ANOTHER OBJECT of the present invention is to provide a flexible waterproof applique for accurate mounting directly to swimming pools and the like wherein by progressively removing each remaining release sheet intermediate portion and each of the at least two release sheet outer portions the initially properly positioned flexible waterproof sheet is progressively adhered to the swimming pool inner surface free of wrinkles and bubbles.

YET STILL ANOTHER OBJECT of the present invention is to provide a flexible waterproof applique for accurate mounting directly to swimming pools and the like that further includes printed matter located on the flexible waterproof sheet.

STILL YET ANOTHER OBJECT of the present invention is to provide a flexible waterproof applique for accurate mounting directly to swimming pools and the like that further includes an air tight pouch that contains an inert gas.

YET STILL ANOTHER OBJECT of the present invention is to provide a flexible waterproof applique for accurate mounting directly to swimming pools and the like wherein the at least two release sheet slits is a pair.

STILL YET ANOTHER OBJECT of the present invention is to provide a flexible waterproof applique for accurate mounting directly to swimming pools and the like wherein the at least one release sheet intermediate portion is one.

YET STILL ANOTHER OBJECT of the present invention is to provide a flexible waterproof applique for accurate mounting directly to swimming pools and the like wherein the flexible waterproof sheet has a shape that is a fish.

FINALLY, ANOTHER OBJECT of the present invention is to provide a flexible waterproof applique for accurate mounting directly to swimming pools and the like wherein the flexible waterproof sheet has a shape that is a depth gauge.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTIONS OF THE DRAWING

Figure 10:
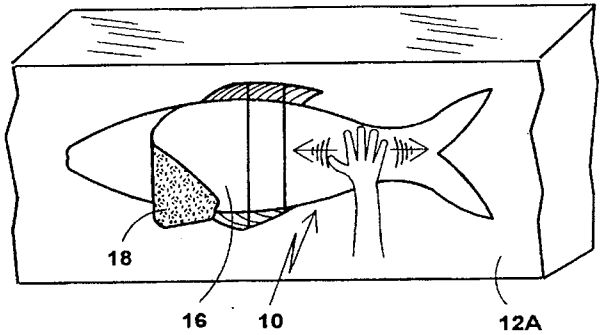
Figure 11:
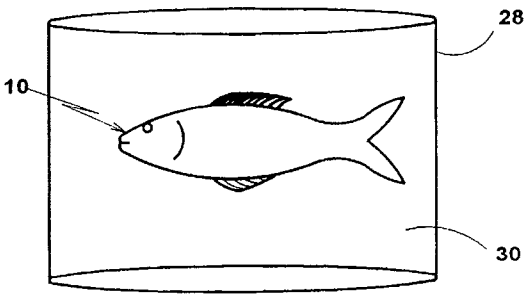

FIG. 10 is a perspective view of the flexible waterproof applique for direct mounting to swimming pools and the like of the present invention having the remaining exposed portions being applied to the inner surface of the swimming pool; and FIG. 11 is a perspective view of the flexible waterproof applique for direct mounting to swimming pools and the like of the present invention in an air tight pouch.

List of Reference Numerals Utilized in the Drawing

10—flexible waterproof applique for accurate mounting directly to swimming pools and the like of the present invention

12—swimming pool

12A—swimming pool interior surface

14—chlorine water

16—waterproof flexible sheet

16A—waterproof flexible sheet front surface

16B—waterproof flexible sheet rear surface

18—waterproof adhesive layer

20—waterproof release sheet

20A—waterproof flexible sheet first outer portion

20AA—waterproof flexible sheet first outer portion proximal end

20AB—waterproof flexible sheet first outer portion distal end

20B—waterproof flexible sheet intermediate portion

20C—waterproof flexible sheet second outer portion

20CA—waterproof flexible sheet second outer portion proximal end

20CB—waterproof flexible sheet second outer portion distal end

22—printed matter

22A—printed matter eye

22B—printed matter gills

22C—printed matter scales

22D—printed matter legend

22E—printed matter indicia

24—first slit

26—second slit

28—air tight pouch

30—inert gas

DETAILED DESCRIPTION OF THE PREFERRED EMBODIMENT

Figure 1:
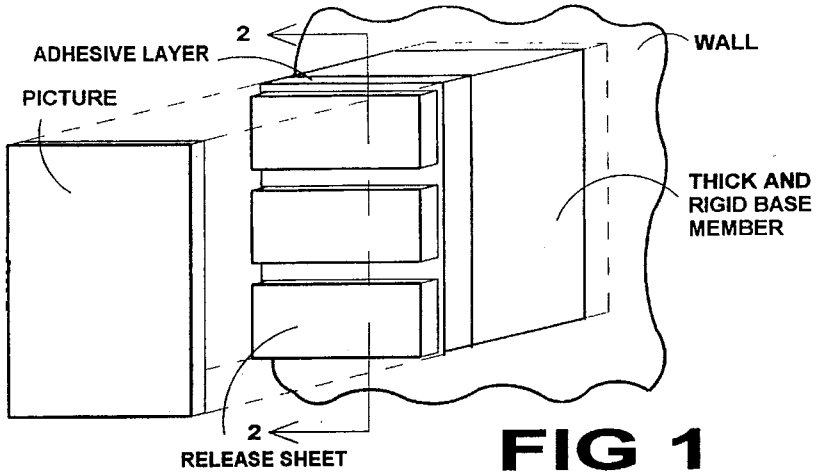
FIG. 1 is a perspective view of a prior art adhesive picture mount.
Figure 2:
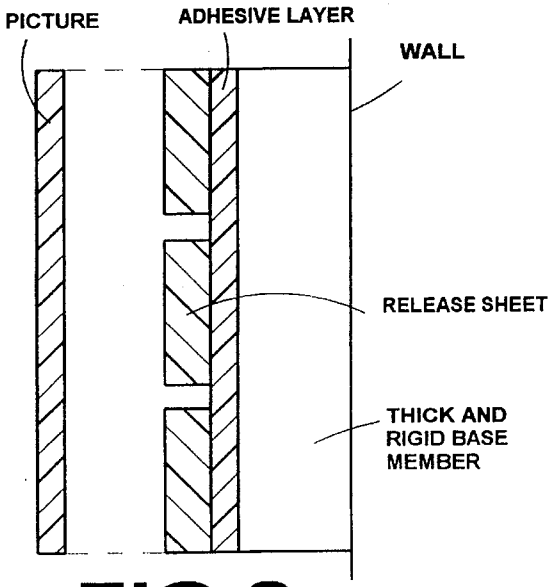
FIG. 2 is a cross-sectional view taken along line 1—1 in FIG. 1.
Figure 3:
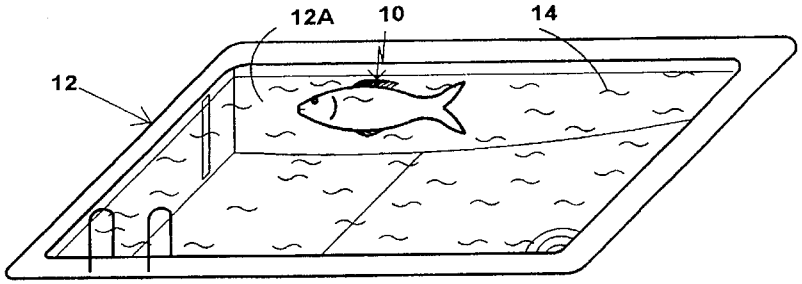
FIG. 3 is a perspective view of the flexible waterproof applique of the present invention mounted directly to an inner surface of a swimming pool.

Referring now to the figures in which like numerals indicate like parts, and particularly to FIG. 3, the flexible waterproof applique for accurate mounting directly to swimming pools and the like is shown generally at 10, attached directly to a swimming pool interior surface 12A of a swimming pool 12, while the flexible waterproof applique for accurate mounting directly to swimming pools and the like 10 is submerged under water 14.

Figure 4:
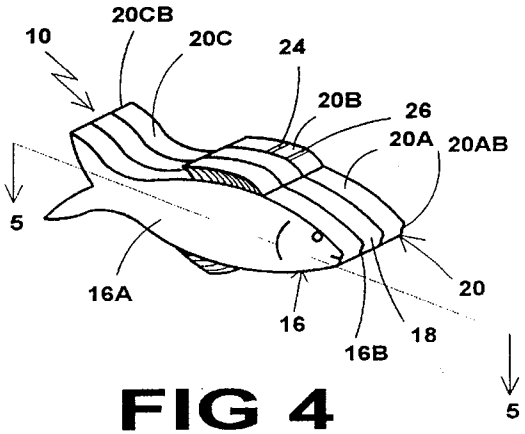
FIG. 4 is a perspective view of the flexible waterproof applique for accurate mounting directly to swimming pools and the like of the present invention.
Figure 5:
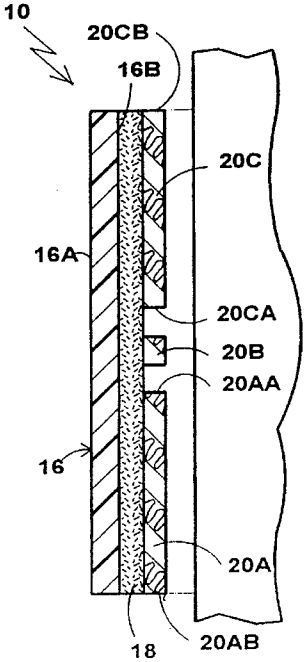
FIG. 5 is a cross-sectional view taken along line 5—5 in FIG. 4.

The configuration of the flexible waterproof applique for accurate mounting directly to swimming pools and the like 10, is best shown in FIGS. 4 and 5, and as such, will be discussed with reference thereto.

The flexible waterproof applique for accurate mounting directly to swimming pools and the like 10 includes a flexible waterproof sheet 16, a waterproof adhesive layer 18, and a release sheet 20.

The flexible waterproof sheet 16 has a flexible waterproof sheet front surface 16A, a flexible waterproof sheet back surface 16B, and a flexible waterproof sheet shape 16C. Printed matter 22 is located on the flexible waterproof sheet front surface 16A of the waterproof sheet 16. The entire flexible waterproof sheet back surface 16B of the flexible waterproof sheet 16 is covered by the waterproof adhesive layer 18 while the entire waterproof adhesive layer 18 is covered by the release sheet 20.

By having the entire flexible waterproof sheet back surface 16B of the flexible waterproof sheet 16 covered by the waterproof adhesive layer 18, water 14 is prevented from entering behind the flexible waterproof sheet 16 when the flexible waterproof applique for accurate mounting directly to swimming pools and the like 10 is directly mounted to the swimming pool interior surface 12A of a swimming pool 12. The flexible waterproof applique for accurate mounting directly to swimming pools and the like 10 will not lift off of the swimming pool interior surface 12A of the swimming pool 12.

The release sheet 20 contains at least two spaced apart slits, namely, a first slit 24 and a second slit 26. The first slit 24 and the second slit 26 divide the release sheet 20 into at least three individual release sheet portions, namely, a release sheet first outer individual portion 20A with a release sheet first outer individual portion proximal end 20AA and a release sheet first outer individual portion distal end 20AB, a release sheet intermediate individual portion 20B, and a release sheet second outer individual portion 20C with a release sheet second outer individual portion proximal end 20CA and a release sheet second outer individual portion distal end 20CB. Each having the ability to be removed individually.

The release sheet intermediate individual portion 20B of the release sheet 20 is located at the middle of the release sheet 20 and is smaller in size than both the release sheet first outer individual portion 20A of the release sheet 20 and the release sheet second outer individual portion 20C of the release sheet 20.

The use of multiple release sections makes possible incremental removal of the sections of the release sheet 18, progressively outward from the initially exposed waterproof adhesive area subsequent to adhering the initially exposed waterproof adhesive area to the swimming pool interior surface 12A of a swimming pool 12. This assures a gradual and progressive outward exposure of the waterproof adhesive layer 18 and substantially facilitates the smooth adherence of the flexible waterproof applique for accurate mounting directly to swimming pools and the like 10 throughout its entire area.

The flexible waterproof sheet 16 is thin and is manufactured from a polyester and the waterproof adhesive layer 18 can be pressure sensitive. The release sheet 20 has a non-stick surface made from a release agent that may be wax so that a user can easily peel off the release sheet 20 from the waterproof adhesive layer 18.

Figure 6:
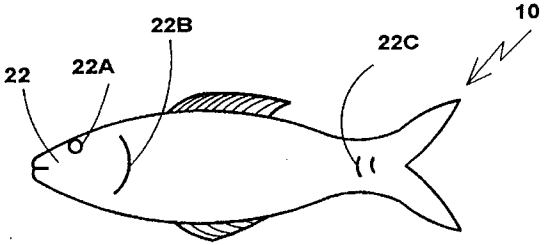
FIG. 6 is a side view of the flexible waterproof applique for accurate mounting directly to swimming pools and the like of the present invention in the form of a fish.

The shape of the flexible waterproof applique for accurate mounting directly to swimming pools and the like 10 can vary depending upon user preference. For example, as shown in FIG. 6, the shape of the flexible waterproof applique for accurate mounting directly to swimming pools and the like 10 is a fish wherein the printed matter 22 includes a printed matter eye 22A, printed matter gills 22B, and printed matter scales 22C.

Figure 7:
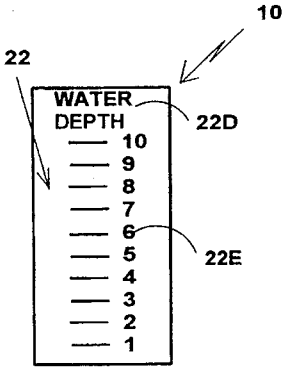
FIG. 7 is a side view of the flexible waterproof applique for accurate mounting directly to swimming pools and the like of the present invention in the form of a depth gauge.

Another example can be seen in FIG. 7, where the shape of the flexible waterproof applique for accurate mounting directly to swimming pools and the like 10 is a gauge wherein the printed matter 22 includes a primed matter legend 22D and printed matter indicia 20E.

Figure 8:
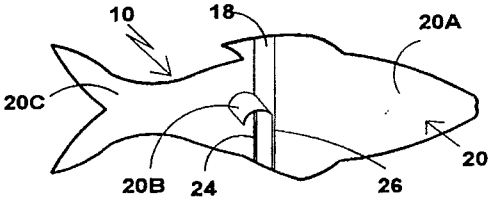
FIG. 8 is a rear side view of the flexible waterproof applique for accurate mounting directly to swimming pools and the like of the present invention with the release sheet intermediate portion being removed.
Figure 9:
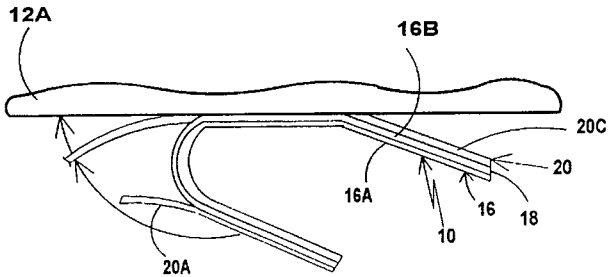
FIG. 9 is a side view of the flexible waterproof applique for accurate mounting directly to swimming pools and the like of the present invention which is initially positioned on the inner surface of the swimming pool.

The method for installing the flexible waterproof applique for accurate mounting directly to swimming pools and the like 10 to a swimming pool interior surface 12A of a swimming pool 12 while under water 14 can best be seen in FIGS. 8 through 10, and as such, will be discussed with reference thereto.

The flexible waterproof applique for accurate mounting directly to swimming pools and the like 10 operates under the principle that by uncovering and/or exposing only a small or narrow area of the waterproof adhesive layer 18 while the remainder of the waterproof adhesive layer 18 remains covered by the release sheet 20 provides protection from unintentional contact. The flexible waterproof applique for accurate mounting directly to swimming pools and the like 10 can be moved freely over the swimming pool interior surface 12A of the swimming pool 12 without the exposed waterproof adhesive layer 18 contacting the swimming pool interior surface 12A of the swimming pool 12.

This allows the flexible waterproof applique for accurate mounting directly to swimming pools and the like 10 to be guided into the required location on the swimming pool interior surface 12A of the swimming pool 12. Due to the relative small size of the release sheet intermediate portion 20B of the release sheet 20 and the thickness of the release sheet 20, the remaining release sheet 20 keeps the flexible waterproof sheet 16 above the surface of, and from contacting, the swimming pool interior surface 12A of the swimming pool 12 until it is desired to press the exposed waterproof adhesive layer into contact with the swimming pool interior surface 12A of the swimming pool 12.

The release sheet intermediate individual portion 20B of the release sheet 20 is removed from the flexible waterproof sheet back surface 16B of the flexible waterproof sheet 16. The flexible waterproof applique for accurate mounting directly to swimming pools and the like 10 is placed on the swimming pool interior surface 12A of the swimming pool 12 with the release sheet first outer individual portion 20A of the release sheet 20 and the release sheet second outer individual portion 20C contacting the swimming pool interior surface 12A of the swimming pool 12. The flexible waterproof applique for accurate mounting directly to swimming pools and the like 10 can then be moved freely without the exposed portion of the waterproof adhesive layer 18 contacting the swimming pool interior surface 12A of the swimming pool 12.

After the flexible waterproof applique for accurate mounting directly to swimming pools and the like 10 is accurately located and aligned on the swimming pool interior surface 12A of the swimming pool 12, the user presses a finger against the central portion of the flexible waterproof sheet 16 that has the exposed waterproof adhesive disposed thereon and presses that portion of the waterproof sheet 16 into adhering contact with the swimming pool interior surface 12A of the swimming pool 12. This retains the applique for accurate mounting directly to swimming pools and the like 10 in the required location.

One end of the flexible waterproof sheet 16 is then bent away from the swimming pool interior surface 12A of the swimming pool 12, producing stresses, so that the release sheet first outer portion proximal end 20AA of the release sheet first outer portion 20A of the release sheet 20 moves away from the waterproof adhesive layer 18. This enables the user to grip the release sheet first outer portion 20A of the release sheet 20 and separate it from the waterproof adhesive layer 18 by peeling and pulling it towards the release sheet first outer portion distal end 20AB of the release sheet first outer portion 20A of the release sheet 20.

After the release sheet first outer portion 20A of the release sheet 20 is removed from the waterproof adhesive layer 18, the user presses a hand against that portion of the flexible waterproof sheet 16 that now has the exposed waterproof adhesive disposed thereon and presses that portion of the waterproof sheet 16 into adhering contact with the swimming pool interior surface 12A of the swimming pool 12. The user then moves the hand in a smooth motion from the center towards the end of the flexible waterproof sheet 16 so that bubbles and wrinkles are removed and that part of the flexible waterproof sheet 16 is adhered to the swimming pool interior surface 12A of the swimming pool 12.

The other end of the flexible waterproof sheet 16 is then bent away from the swimming pool interior surface 12A of the swimming pool 12, producing stresses, so that the release sheet second portion proximal end 20CA of the release sheet second outer portion 20C of the release sheet 20 moves away from the waterproof adhesive layer 18. This enables the user to grip the release sheet second outer portion 20C of the release sheet 20 and separate it from the waterproof adhesive layer 18 by peeling and pulling it towards the release sheet second outer portion distal end 20CB of the release sheet second outer portion 20C of the release sheet 20.

After the release sheet second outer portion 20C of the release sheet 20 is removed from the waterproof adhesive layer 18, the user presses the hand against that portion of the flexible waterproof sheet 16 that now has the exposed waterproof adhesive disposed thereon and presses that portion of the waterproof sheet 16 into adhering contact with the swimming pool interior surface 12A of the swimming pool 12. The user then moves the hand in a smooth motion from the center towards the end of the flexible waterproof sheet 16 so that bubbles and wrinkles are removed and that part of the flexible waterproof sheet 16 is adhered to the swimming pool interior surface 12A of the swimming pool 12.

As can be seen in FIG. 11, the flexible waterproof applique for accurate mounting directly to swimming pools and the like 10 can be enclosed in an air tight pouch 24 that is filled with an inert gas 26.

The use of the air tight pouch 24 prevents degradation of the various components of the flexible waterproof applique for accurate mounting directly to swimming pools and the like 10. By employing the inert gas 26 within the air tight pouch 24, the waterproof adhesive layer 18 remains inactive. However, when the air tight pouch 24 is opened and the flexible waterproof applique for accurate mounting directly to swimming pools and the like 10 is submerged in the water 14 contained in the swimming pool 12, the water becomes the catalyst and the waterproof adhesive layer 18 becomes active, ready for application.

It will be understood that each of the elements described above, or two or more together, may also find a useful application in other types of constructions differing from the types described above.

While the invention has been illustrated and described as embodied in a flexible waterproof applique for accurate mounting directly to swimming pools and the like, it is not intended to be limited to the details shown, since it will be understood that various omissions, modifications, substitutions and changes in the forms and details of the device illustrated and in its operation can be made by those skilled in the an without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed as new and desired to be protected by Letters Patent is set forth in the appended claims.

1. A flexible waterproof applique accurately mountable directly to a swimming pool, comprising:

a) a flexible waterproof sheet having a flexible waterproof sheet front surface and a flexible waterproof sheet rear surface, the flexible sheet further comprising printed matter disposed on the flexible waterproof sheet front surface;

b) a waterproof adhesive layer entirely covering the flexible waterproof sheet rear surface so that water in the swimming pool is prevented from coming between the flexible waterproof sheet and the swimming pool, preventing lifting of the flexible waterproof sheet away from the swimming pool, the waterproof adhesive layer further comprising an adhesive that is activated in the presence of water;

c) a waterproof release sheet containing at least two slits disposed therethrough, said slits defining at least one release sheet intermediate portion and at least two release sheet outer portions, each of the release sheet outer portions being larger than each of the release sheet intermediate portions so that by removing one of the release sheet intermediate portions, a portion of the adhesive layer becomes exposed allowing the flexible waterproof sheet to be properly positioned on the swimming pool interior surface, and by progressively removing each remaining release sheet intermediate portion and each of the release sheet outer portions, the properly positioned flexible sheet is progressively adhered to the swimming pool free of wrinkles and bubbles; and d) flexible waterproof said applique contained within an air tight pouch containing an inert gas functioning to prevent the waterproof adhesive layer activating until water is present.

2. The applique as defined in claim 1, wherein said flexible waterproof sheet is manufactured from a polyester material.

3. The applique as defined in claim 1, wherein said flexible waterproof sheet has a shape that is a fish.

4. The applique as defined in claim 1, wherein said flexible waterproof sheet has a shape that is a depth gauge.

* * * * *